US008684359B2

(12) United States Patent
Kang

(10) Patent No.: US 8,684,359 B2
(45) Date of Patent: Apr. 1, 2014

(54) APPARATUS AND METHOD FOR DRIVING ROULETTE GAME MACHINE

(75) Inventor: Hak Jin Kang, Namyangju-si (KR)

(73) Assignee: Andamiro Co., Ltd., Goyang-si (KR)

( * ) Notice: Subject to any disclaimer, the term of this patent is extended or adjusted under 35 U.S.C. 154(b) by 0 days.

(21) Appl. No.: 13/144,513

(22) PCT Filed: Jun. 16, 2011

(86) PCT No.: PCT/KR2011/004403

§ 371 (c)(1),
(2), (4) Date: Jul. 14, 2011

(87) PCT Pub. No.: WO2011/159105

PCT Pub. Date: Dec. 22, 2011

(65) Prior Publication Data

US 2013/0154186 A1 Jun. 20, 2013

(30) Foreign Application Priority Data

Jun. 16, 2010 (KR) ..... 10-2010-0057018

(51) Int. Cl.
*A63B 71/00* (2006.01)

(52) U.S. Cl.
USPC ..... 273/142 J

(58) Field of Classification Search
None
See application file for complete search history.

(56) References Cited

U.S. PATENT DOCUMENTS 3,804,419 A * 4/1974 Jackson ..... 273/142 HA
3,810,628 A * 5/1974 Vigan ..... 273/142 HA
3,817,532 A * 6/1974 Lee ..... 273/142 HA
3,853,324 A * 12/1974 Reiner et al. ..... 273/142 E
3,941,389 A * 3/1976 Guimond ..... 273/142 HA
4,306,368 A * 12/1981 Coghill et al. ..... 40/496
4,492,378 A * 1/1985 Williams ..... 273/142 HA
4,911,448 A * 3/1990 Thomas ..... 273/142 R
5,048,832 A * 9/1991 Kaminkow ..... 273/129 V
5,639,089 A * 6/1997 Matsumoto et al. ..... 273/142 E
5,755,619 A * 5/1998 Matsumoto et al. ..... 463/19
5,827,119 A * 10/1998 Bromley ..... 463/7
6,042,114 A * 3/2000 Phillip ..... 273/142 R
6,059,658 A * 5/2000 Mangano et al. ..... 463/16
6,059,659 A * 5/2000 Busch et al. ..... 463/17
6,082,734 A * 7/2000 Uehara et al. ..... 273/142 E
6,083,105 A * 7/2000 Ronin et al. ..... 463/17
6,164,647 A * 12/2000 Chee ..... 273/142 R
6,227,542 B1 * 5/2001 Cosmi ..... 273/142 E
6,467,770 B1 * 10/2002 Matosevic ..... 273/274
6,520,854 B1 * 2/2003 McNally ..... 463/17
6,663,106 B1 * 12/2003 Cosmi ..... 273/142 E
6,733,388 B2 * 5/2004 Mothwurf ..... 463/17
7,311,305 B2 * 12/2007 Matsuno et al. ..... 273/142 E
7,420,298 B2 * 9/2008 Botos et al. ..... 310/12.14
7,461,842 B2 * 12/2008 Wu ..... 273/142 R (Continued)

*Primary Examiner* — Kurt Fernstrom
*Assistant Examiner* — Dolores Collins
(74) *Attorney, Agent, or Firm* — LRK Patent Law Firm

(57) ABSTRACT

An apparatus for driving a roulette game machine is provided. The apparatus is operated in such a way that a rotor and a stator are attached to each other by electromagnetic force generated from a coil unit and are integrally rotated, and then the rotor is separated from the stator after a predetermined time period has passed. Therefore, at an initial stage of the rotation, an inner wheel and an outer wheel are coupled to each other and rotated together. After a predetermined time period has passed, the inner wheel and the outer wheel are separated from each other and independently rotated at different speeds before stopping. Therefore, the present invention can make the roulette game more interesting.

11 Claims, 10 Drawing Sheets

(56) References Cited

U.S. PATENT DOCUMENTS

| | | | | |
|---|---|---|---|---|
| 7,571,910 | B1 * | 8/2009 | Launzel | 273/142 HA |
| 7,677,571 | B2 * | 3/2010 | Adams, III | 273/274 |
| 7,722,046 | B2 * | 5/2010 | Lawrence et al. | 273/274 |
| 7,815,187 | B2 * | 10/2010 | Yokota | 273/142 E |
| 7,841,597 | B2 * | 11/2010 | Cammegh | 273/142 R |
| 7,862,422 | B2 * | 1/2011 | Garamendi et al. | 463/20 |
| 7,864,009 | B2 * | 1/2011 | Fullerton et al. | 335/306 |
| 7,896,734 | B2 * | 3/2011 | Kaminkow et al. | 463/16 |
| 7,926,808 | B1 * | 4/2011 | Gullotta | 273/142 R |
| 7,926,810 | B2 * | 4/2011 | Fisher et al. | 273/274 |
| 8,191,893 | B2 * | 6/2012 | Cammegh et al. | 273/142 E |
| 8,262,452 | B2 * | 9/2012 | Okuaki et al. | 463/16 |
| 8,267,403 | B2 * | 9/2012 | Fisher et al. | 273/142 B |
| 8,333,655 | B2 * | 12/2012 | Gagner et al. | 463/25 |
| 8,348,277 | B2 * | 1/2013 | Fitoussi et al. | 273/142 E |
| 8,395,467 | B2 * | 3/2013 | Fullerton et al. | 335/285 |
| 8,419,549 | B2 * | 4/2013 | Kaminkow et al. | 463/46 |
| 2006/0287053 | A1 * | 12/2006 | Yokota | 463/17 |

* cited by examiner

APPARATUS AND METHOD FOR DRIVING ROULETTE GAME MACHINE

CROSS REFERENCE TO RELATED APPLICATION

This application is a National Stage of International Application No. PCT/KR2011/004403 filed Jun. 16, 2011, claiming priority based on Korean Patent Application No. 10-2010-0057018 filed Jun. 16, 2010, the content of which is incorporated herein by reference in its entirety.

TECHNICAL FIELD

The present invention relates generally to roulette game machines and, more particularly, to an apparatus for driving a roulette game machine which includes a coil, a stator, and a rotor and is operated in such a way that an inner wheel is attached to an outer wheel by applying power to the coil so that the inner wheel rotates along with the outer wheel, and when power applied to the coil is interrupted, the inner wheel is separated from the outer wheel so that the inner wheel and the outer wheel stop after different time periods have passed, and a method for driving the roulette game machine.

BACKGROUND ART

Generally, a roulette game is a traditional table game which is played according to the following method. A dealer manually rolls a single ball having a diameter ranging from 19 mm to 25 mm onto a rotating plate (roulette wheel) in a direction opposite to the direction in which the roulette wheel rotates. The ball eventually loses momentum and falls into one of numbered pockets. Then, the dealer checks the winning number with the naked eyes and provides a preset dividend to a player who has bet on the corresponding number. Such a conventional manual one-ball roulette game is a very simple table game that doesn't require a special technique. In particular, beginners or woman players enjoy this game a great deal.

The conventional manual one-ball roulette game uses a roulette wheel (rotating plate) on which numerals from 0 to 36 are marked and regularly arranged. Methods of playing such a roulette game are classified into a European method having a single pocket numbered 0 (zero) and an American method having two pockets numbered 0 (zero).

Furthermore, as general methods of rotating the roulette wheel, a dealer may directly hold the roulette wheel with his/her hand and rotate it, and the roulette wheel may be connected to a power source and electrically rotated. As such, conventional roulette game machines are configured in such a way that the roulette wheel is horizontally placed and a portion on which points or numbers are marked is oriented upwards and exposed.

To play the conventional roulette game, the roulette wheel placed on a table must be exposed upwards. In other words, the roulette wheel can be placed only horizontally. Thus, installation of the roulette game machine is limited. In addition, there is a disadvantage in that a dealer is indispensable.

Moreover, the conventional roulette game is a player-passive type of game in which a dealer leads a game and players merely bet on an expected winning number. That is, the dealer manually directly rotates the roulette wheel and rolls the ball onto the roulette wheel, but the players cannot directly participate in the progress of the game.

Meanwhile, there is a game method in which a user directly rotates a roulette wheel (for example, this is mainly used in TV programs), but in this case, the user may fake the position at which the wheel stops, thus making the game unfair.

DISCLOSURE

Technical Problem

Accordingly, the present invention has been made keeping in mind the above problems occurring in the prior art, and an object of the present invention is to provide an apparatus for driving a roulette game machine which includes an inner wheel and an outer wheel and is operated in such a way that when a player rotates the outer wheel, the inner wheel is attached to the outer wheel and rotated along with the outer wheel before the inner wheel is separated from the outer wheel after a predetermined time period has passed, thus preventing the player from faking the result of the game, and a method for driving the roulette game machine.

Another object of the present invention is to provide an apparatus for driving a roulette game machine which makes it possible to place the roulette game machine upright and enables the player to directly handle the game machine, thus attracting active participation from players, and which is configured in such a way that the inner wheel with a scoreboard is isolated from the outside and rotated by rotating the outer wheel, and a method for driving the roulette game machine.

A further object of the present invention is to provide an apparatus for driving a roulette game machine in which the inner wheel is attached to the outer wheel by electromagnetic force generated from a coil unit so that the inner wheel is rotated along with the outer wheel, and the inner wheel and the outer wheel independently rotate until they stop after they are separate from each other, and a method for driving the roulette game machine.

Yet another object of the present invention is to provide an apparatus for driving a roulette game machine which includes a display unit which is disposed outside the machine so that a score corresponding to the position at which the inner wheel stops is displayed on the display unit, and LEDs which flash on and off to enhance visual effects when the inner wheel rotates, and a method for driving the roulette game machine.

Still another object of the present invention is to provide an apparatus for driving a roulette game machine in which, when the wheel is expected to repeatedly stop at a specific position, the position at which the wheel stops can be changed by the operation of a motor, and a method for driving the roulette game machine.

Technical Solution

In order to accomplish the above objects, in an aspect, the present invention provides an apparatus for driving a roulette game machine played in such a way that a scoreboard which is partitioned into a plurality of sections at predetermined intervals is rotated, and a score is determined depending on a position at which a stopper is placed on the scoreboard when the scoreboard stops, the drive apparatus including: a support shaft; a coil unit coupled to the support shaft; an outer wheel rotatably coupled to the support shaft, the outer wheel having a planar shape with a hollow space and comprising a stator provided at a position facing the coil unit; and an inner wheel rotatably coupled to the support shaft and disposed in the hollow space of the outer wheel, the inner wheel comprising a rotor provided at a position corresponding the stator, wherein the rotor of the inner wheel and the stator of the outer wheel are attached to or separated from each other depending on turning power applied to the coil unit on/off.

In another aspect, the present invention provides an apparatus for driving a roulette game machine played in such a way that a scoreboard which is partitioned into a plurality of sections at predetermined intervals is rotated, and a score is determined depending on a position at which a stopper is placed on the scoreboard when the scoreboard stops, the drive apparatus including: a support shaft; a coil unit coupled to the support shaft; a stator rotatably coupled to the support shaft at a position facing the coil unit; a rotor rotatably coupled to the support shaft at a position facing the stator; an outer wheel having a planar shape with a hollow space; and an inner wheel disposed in the hollow space of the outer wheel, the inner wheel having the scoreboard, wherein the stator is coupled to either the outer wheel or the inner wheel and the rotor is coupled to a remaining one of the outer wheel and the inner wheel, and the stator and the rotor are attached to or separated from each other depending on turning power applied to the coil unit on/off.

In a further aspect, the present invention provides a method of driving a roulette game machine, including an inner wheel, an outer wheel, and a coil unit configured such that an inner wheel and an outer wheel are attached to each other by electromagnetic force generated from the coil unit and are rotated, the roulette game machine being played in such a way that a scoreboard which is disposed inside the outer wheel and partitioned into a plurality of sections at predetermined intervals is rotated, and a score is determined depending on a position at which a stopper of the inner wheel is placed on the scoreboard when the scoreboard stops, the method including: (a) applying power to the coil unit to attach the inner wheel to the outer wheel so that the inner wheel is rotated along with the outer wheel; (b) determining using a control unit whether one from among a speed at which the inner wheel rotates, the number of rotations of the inner wheel, and a duration during which the inner wheel rotates exceeds a corresponding preset standard; (C) interrupting power applied to the coil unit using the control unit to separate the inner wheel from the outer wheel when, at (b) determining, one from among the speed, the number of rotations, and the rotation duration of the inner wheel exceeds a corresponding preset standard; (d) determining whether the inner wheel is in a stop state; and (e) displaying a score, corresponding to a position of the stopper on the scoreboard, on a display unit when, at (d) determining, it is determined that the inner wheel is in the stop state.

In yet another aspect, the present invention provides a method of driving a roulette game machine comprising an inner wheel and an outer wheel which are attached to each other by electromagnetic force and are rotated, the roulette game machine being played in such a way that a scoreboard which is disposed inside the outer wheel and partitioned into a plurality of sections at predetermined intervals is rotated, and a score is determined depending on a position at which a stopper of the inner wheel is placed on the scoreboard when the scoreboard stops, the method including: (a) applying power to a coil unit to attach the inner wheel to the outer wheel so that the inner wheel is rotated along with the outer wheel; (b) determining using a control unit whether one from among a speed at which the outer wheel rotates, the number of rotations of the outer wheel, and a duration during which the outer wheel rotates exceeds a corresponding preset standard; (C) interrupting power applied to the coil unit using the control unit to separate the inner wheel from the outer wheel when, at (b) determining, one from among the speed, the number of rotations, and the rotation duration of the outer wheel exceeds a corresponding preset standard; (d) determining whether the inner wheel is in a stop state; and (e) displaying a score, corresponding to a position of the stopper on the scoreboard, on a display unit when, at (d) determining, it is determined that the inner wheel is in the stop state.

Preferably, (a) applying may comprise applying power to the coil unit when it is determined that the outer wheel rotates. Furthermore, (c) interrupting may include: (c-1) decelerating the separated outer wheel using a speed reducer which is configured in such a way that a bearing of a bearing plate that is rotatably coupled to the support shaft come into close contact with a wheel plate provided on the outer wheel to reduce rotational force of the outer wheel; and (c-2) stopping the inner wheel using friction generated when the stopper comes into contact with stop pins provided on the scoreboard.

In addition, (c-2) stopping may include decelerating the inner wheel using a speed reducer. The speed reducer may include: a motor; a tension spring coupled at a first end thereof to the stopper; and a tension wire coupled to a second end of the tension spring, the tension wire being wound around a pulley of the motor so that a length of the tension wire is varied by rotation of the motor. Preferably, (d) determining may include: (d-1) determining whether the inner wheel stops at a preset position; and (d-2) changing a position, at which the inner wheel stops, by adjusting tension of the stopper using the motor when it is determined that the inner wheel stops at the preset position.

Advantageous Effects

Therefore, in an apparatus for driving a roulette game machine according to the present invention, an inner wheel can be completely isolated from the outside while a roulette game is played. The wheel of the roulette game machine can be oriented in the vertical direction. Therefore, the present invention can attract active participation from players. In addition, when an outer wheel rotates, power is applied to a coil unit so that the inner wheel is attached to the outer wheel and integrally rotated with the outer wheel. When the supply of power is interrupted, the inner wheel is separated from the outer wheel so that the inner and outer wheels independently rotate. Therefore, there is little noise when the drive apparatus is operated. Moreover, the present invention is easy to use.

Furthermore, after the inner and outer wheels which have integrally rotated are separated from each other, they independently rotate at different speeds before stopping. Hence, the roulette game is more interesting.

In addition, the present invention includes LEDs which flash on and off when the inner wheel rotates, thus providing various visual effects. The present invention also includes a sensor which precisely detects the position at which the inner wheel stops and displays a score corresponding to the stop position on a display that is provided outside the game machine. Thus, there is an advantage in that the players can easily check the result of the game.

Moreover, because the position at which the wheel which is rotating stops can be varied by a program, an unexpected result can be produced. Therefore, the players can enjoy the game without stress.

DESCRIPTION OF DRAWINGS

The above and other objects, features and advantages of the present invention will be more clearly understood from the following detailed description taken in conjunction with the accompanying drawings, in which.

MODE FOR INVENTION

The terms and words used in the specification and claims are not necessarily limited to typical or dictionary meanings, but must be understood to indicate concepts selected by the inventor as the best method of illustrating the present invention, and must be interpreted as having meanings and concepts adapted to the scope and sprit of the present invention for understanding the technology of the present invention.

In the specification, when the explanatory phrase "a part includes a component" is used, this means that the part may further include the component without excluding other components, so long as special explanation is not given. Furthermore, terms such as "... unit", "... machine", "module", etc., used in the specification refer to basic elements that can perform at least one function or operation. This can be embodied by combining hardware or software or combining hardware and software.

Hereinafter, an apparatus for driving a roulette game machine according to a preferred embodiment of the present invention will be described in detail with reference to the attached drawings.

Figure 1:
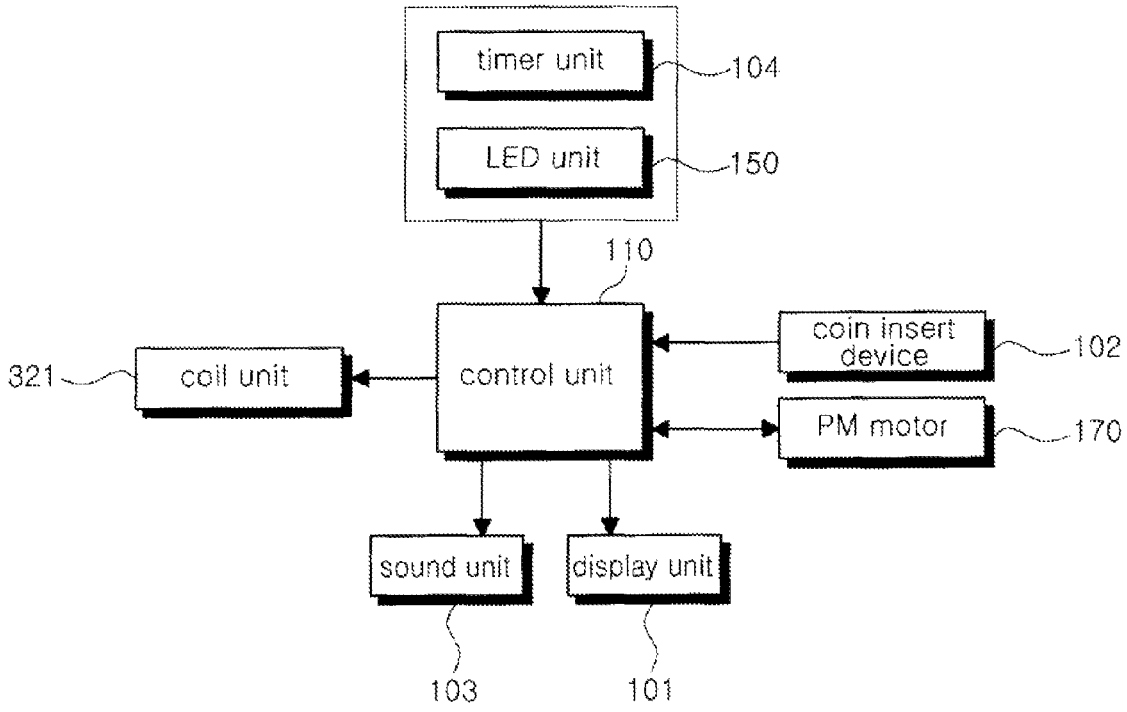
FIG. 1 is a block diagram showing the construction of an apparatus for driving a roulette game machine, according to an embodiment of the present invention.
Figure 2:
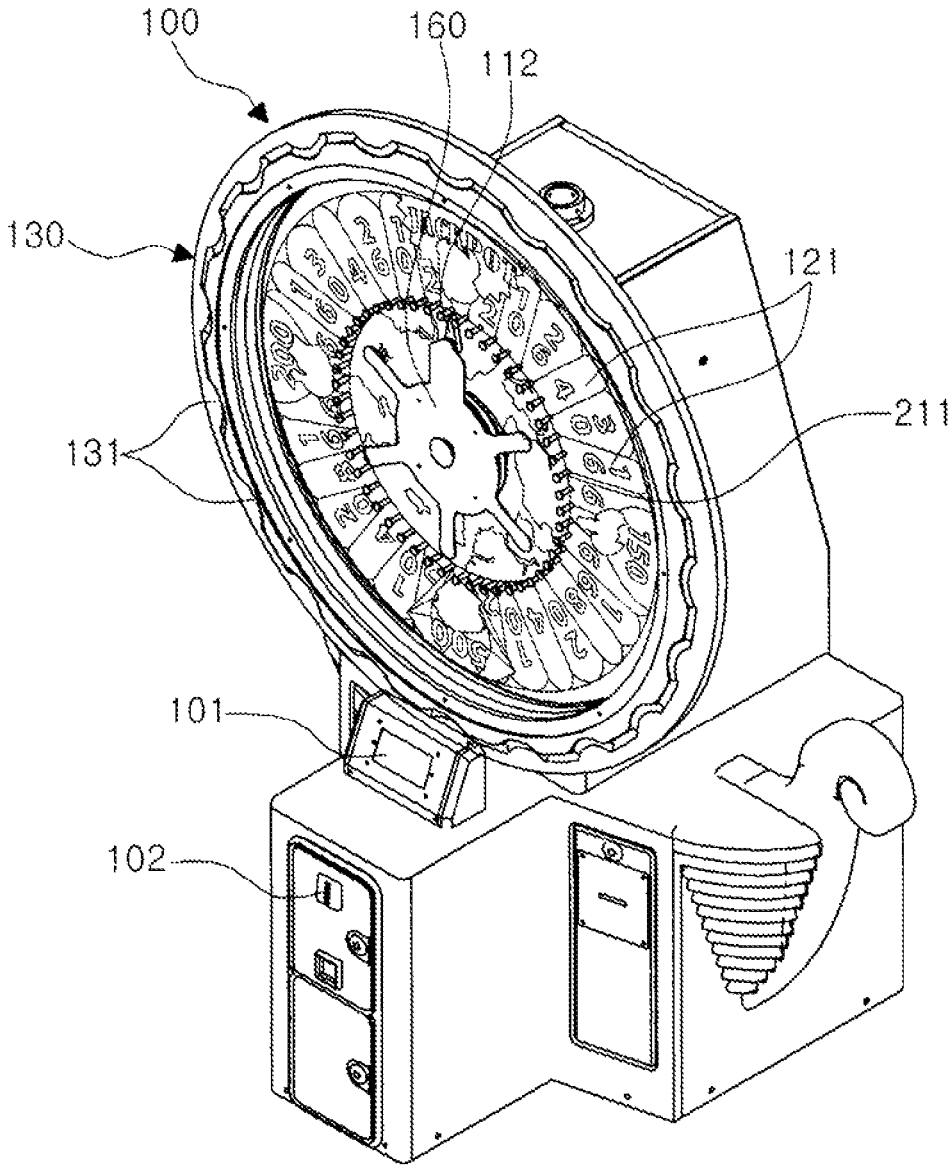
FIG. 2 is a perspective view showing the shape of the roulette game machine according to the present invention.
Figure 3:
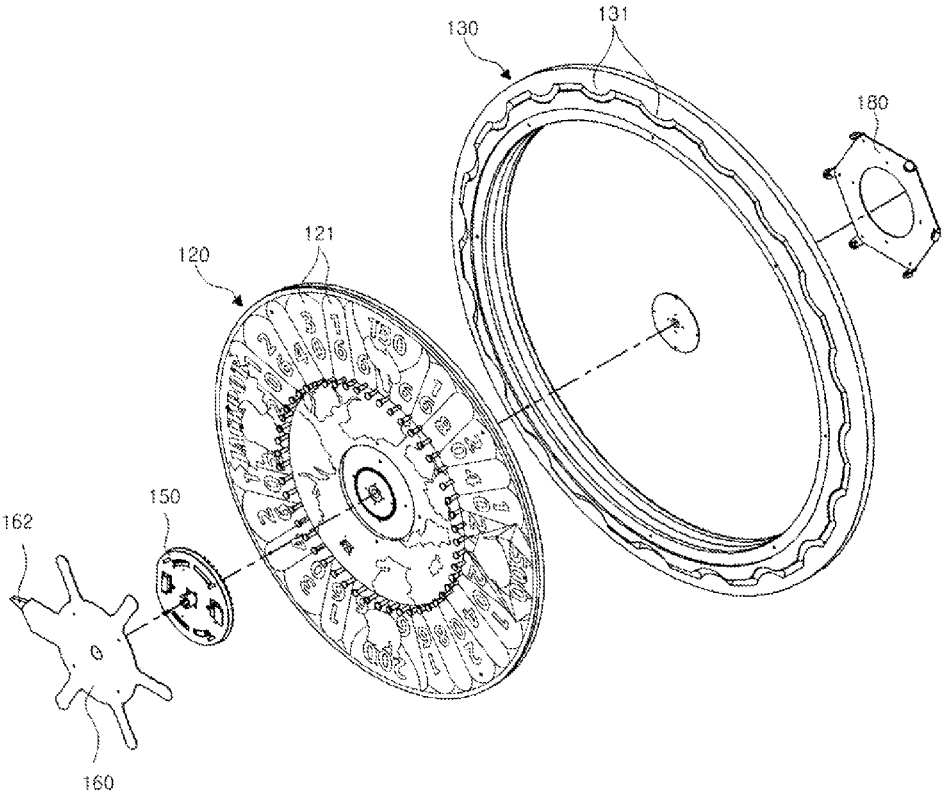
FIG. 3 is an exploded perspective view of a wheel of the roulette game machine of FIG. 2.
Figure 4:
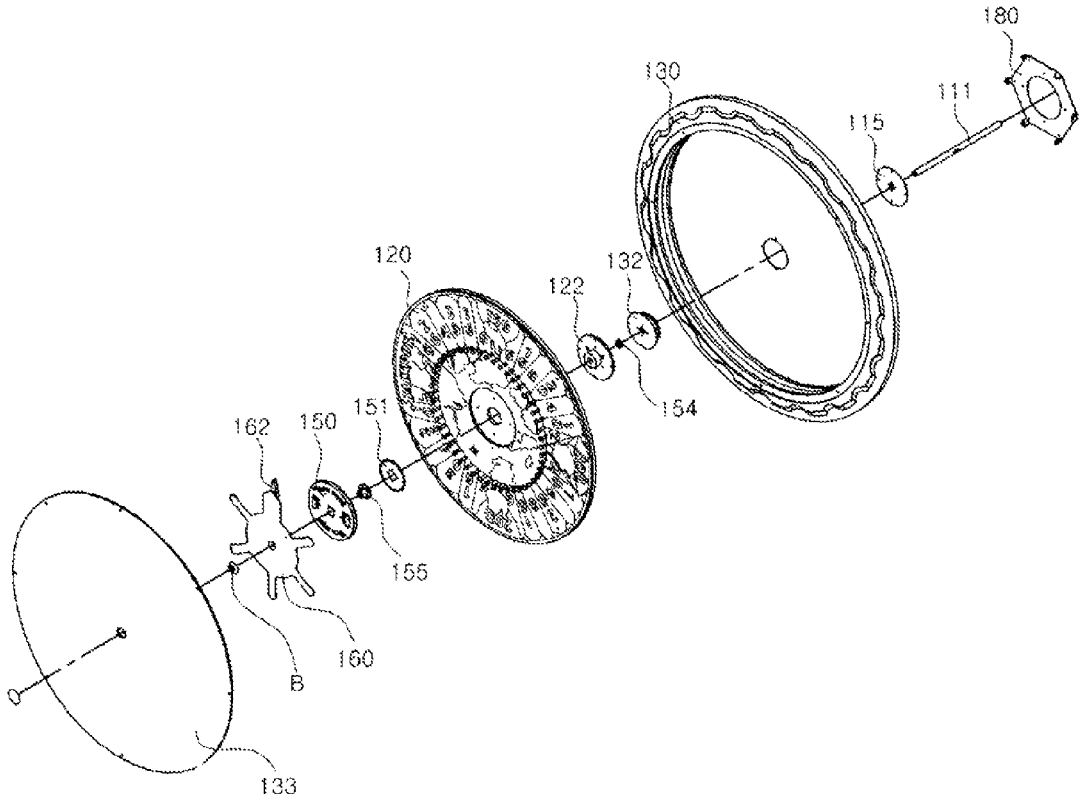
FIG. 4 is an exploded perspective view showing elements pertaining to a drive shaft.
Figure 5:
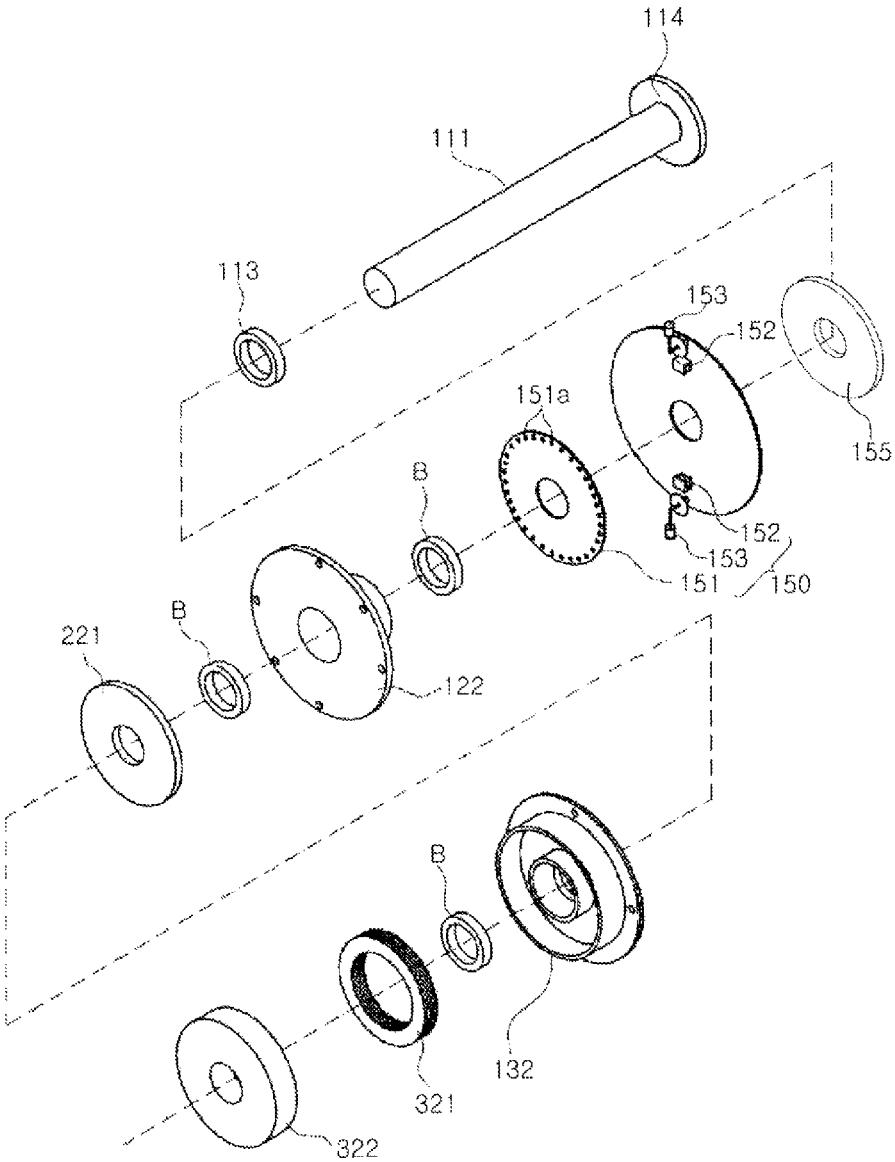
FIG. 5 is an exploded perspective view showing the elements of FIG. 4 in detail.
Figure 6:
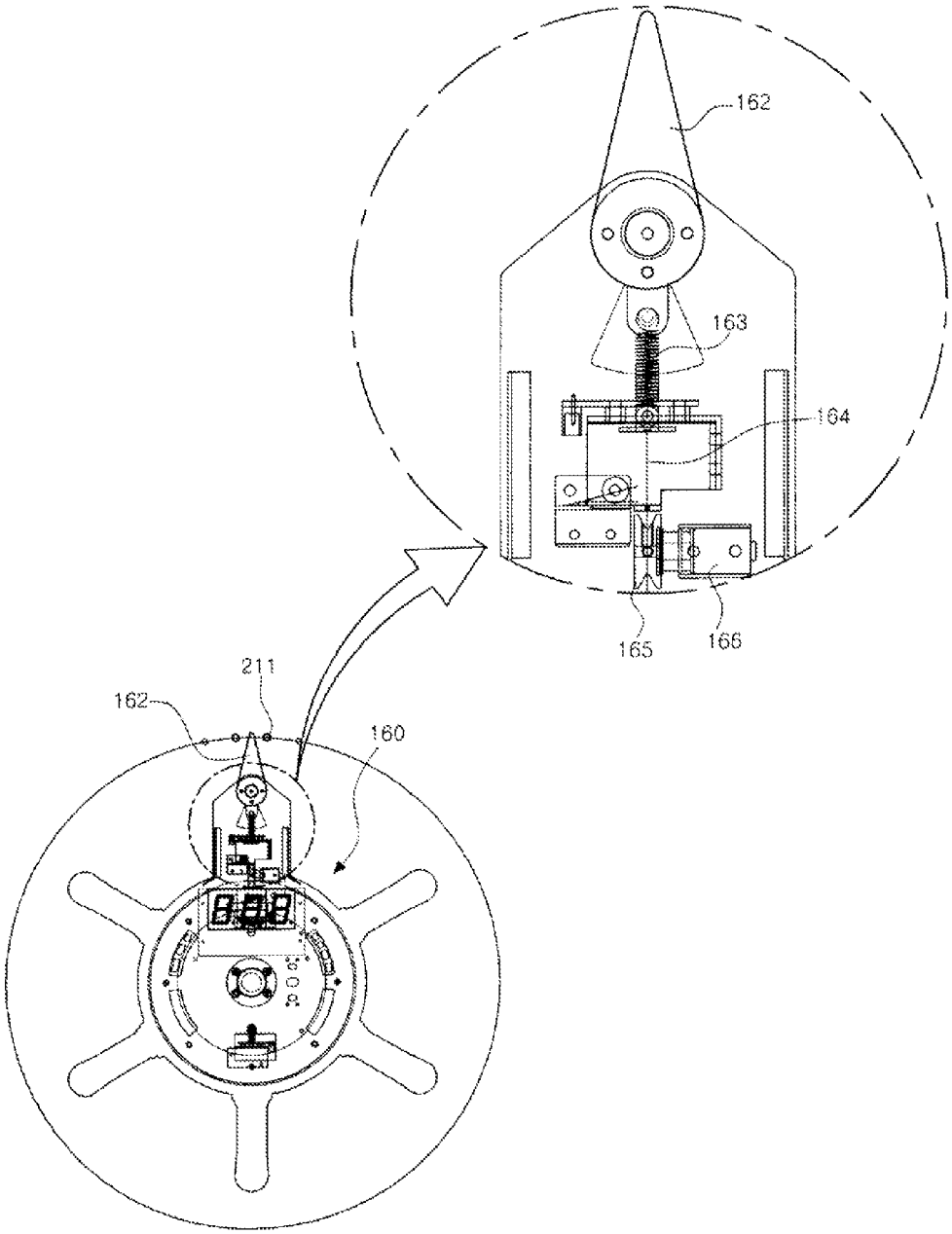
FIG. 6 is an enlarged view showing the construction of a stopper.
Figure 7:
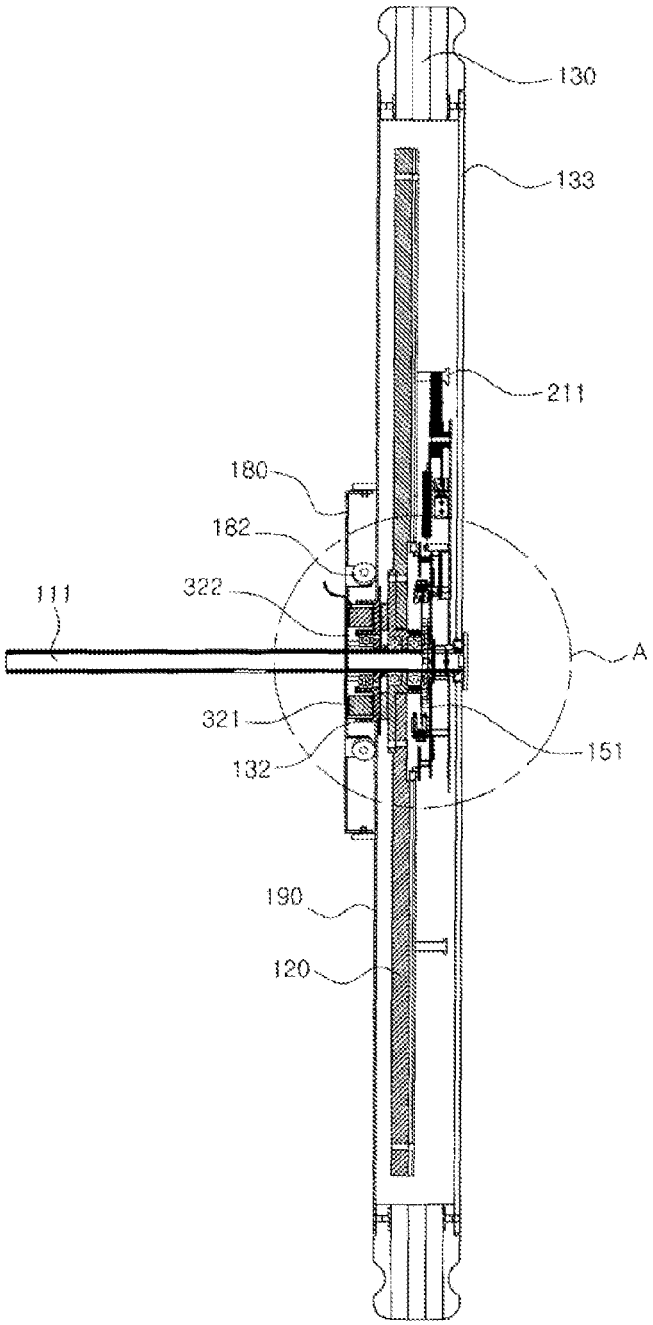
FIG. 7 is a sectional view showing the assembled elements of inner and outer wheels.
Figure 8:
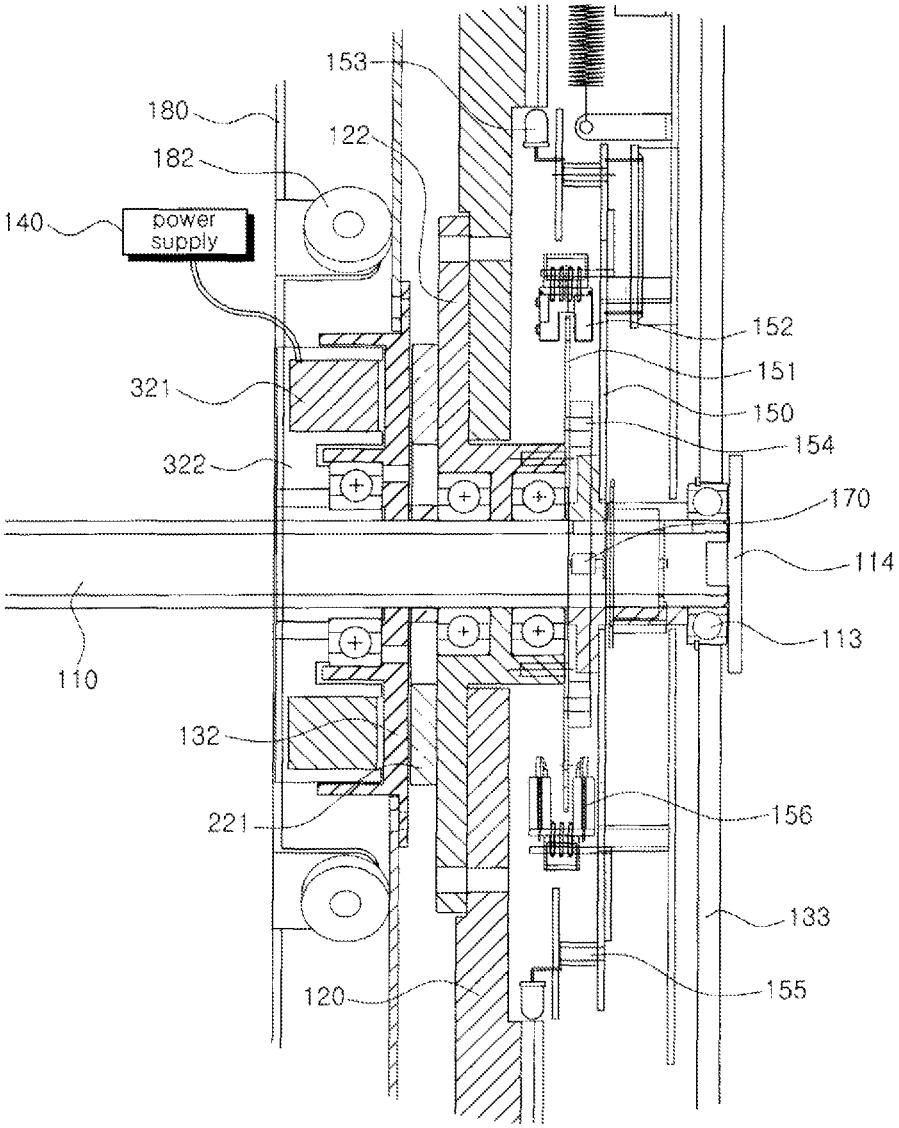
FIG. 8 is an enlarged view showing a portion of FIG. 6.

FIG. 1 is a block diagram showing the construction of an apparatus for driving a roulette game machine according to the present invention. FIG. 2 is a perspective view showing the shape of the roulette game machine. FIG. 3 is an exploded perspective view of a wheel of the roulette game machine. FIG. 4 is an exploded perspective view showing elements pertaining to a drive shaft. FIG. 5 is an exploded perspective view showing the elements of FIG. 4 in detail. FIG. 6 is an enlarged view showing the construction of a stopper. FIG. 7 is a sectional view showing the assembled elements of inner and outer wheels. FIG. 8 is an enlarged view showing a portion of FIG. 6.

As shown in the drawings, the drive apparatus 100 for the roulette game machine includes a timer unit 104, an LED unit 150, a coil unit 321, a sound unit 103, a display unit 101, a coin insert device 102, a motor 166, and a control unit 110.

The timer unit 104 is provided on a stationary part of the roulette game machine and displays the elapsed time of a game.

The coil unit 321 is fitted into an insert hole of a stator 132. The coil unit 321 generates a magnetic field when power is applied thereto, thus magnetizing a metal substance to form an electromagnet.

For this, the stator (electromagnetic stator) 132 includes the coil unit 321 which is connected to a power supply 140, and a metal plate 322 which covers a circumferential outer surface of the coil unit 321. Thus, when electric current is applied to the coil unit 321, the metal plate 322 has characteristics of an electromagnet so that a metal rotor 122 coupled to an inner wheel 120 is attached to the metal plate 322 by electromagnetic force generated from the magnetized metal plate 322.

The structure of the stator and the rotor will be explained in more detail later.

The display unit 101 is configured such that it can emit light or flash a light on and off to improve visual effects and arouse player's interest on the game. The display unit 101 may be provided at a variety of locations of the game machine. To achieve the purposes of the display unit 101, for example, it may comprise a seven-segment display or LEDs. The display unit 101 can display various information, for example, game points, numbers, bonus points, prizes, etc., under the control of the control unit 110. In addition, the display unit 101 may indicate a jackpot game or the number of remaining coins under the control of the control unit 110.

The coin insert device 102 may include a well-known sensor which detects insertion of a coin or token, or a well-known bill sensor which detects a bill or a bill substitute which is input by a bill insert device or a card reader.

The control unit 110 controls the general operation and indication of the roulette game machine. For example, the control unit 110 controls the roulette game machine in such a way that when a coin is inserted into the coin insert device 102 or a separate order is given to start a game, power is applied to the coil unit 321 so that the stator 132 of the outer wheel 130 is electromagnetized and thus attached to the rotor 122 of the inner wheel 120 to rotate the inner wheel 120 along with the outer wheel 130. When it is determined that the outer wheel 130 has rotated for a predetermined time, reached a predetermined speed, or reached a predetermined number of rotations, the control unit 110 interrupts the supply of power to the coil unit 321 so that the inner wheel 120 is separated from the outer wheel 130 which is rotating.

Furthermore, the control unit 110 controls the sound unit 103 and the display unit 101 so that the sound unit 103 outputs rhythmical music and, simultaneously, the display unit 101 flashes on and off in response to the progress of the game.

In addition, the outer wheel 130 includes a wheel plate 190 which is in close contact with bearings 182 of a bearing plate 180 that is rotatably provided on a support shaft 111. Thus, when the control unit 110 interrupts the supply of power, the wheel plate 190 which has rotated is slowly stopped by a reduction of rotational force. The inner wheel 120 includes a scoreboard 121 which is partitioned into a plurality of sections at predetermined intervals, and stop pins 211 which are provided on the scoreboard 121. The inner wheel 120 is configured in such a way that when the supply of power is interrupted, the inner wheel 120 which has rotated is slowly stopped by friction occurring while a stopper 162 comes into contact with the stop pins 211.

The drive apparatus 100 will be explained in more detail with reference to the attached drawings.

Referring to FIGS. 3 and 4 that are respectively an exploded perspective view of the wheel and an exploded perspective view showing elements pertaining to the drive shaft, the drive apparatus 100 is used in the roulette game machine which is played in such a way that the scoreboard 121 that is partitioned into many sections at predetermined intervals is rotated, and a score is determined depending on a position at which the stopper 162 is placed on the scoreboard 121 when the scoreboard 121 stops. The drive apparatus 100 includes the support shaft 111, the coil unit 321, the outer wheel 130, the inner wheel 120, and the control unit 110. The support shaft 111 is oriented in the horizontal direction. The coil unit 321 is coupled to the support shaft 111. The outer wheel 130 has a planar shape having a hollow space and is rotatably provided on the support shaft 111. The outer wheel 130 includes the stator 132 at a position corresponding to the coil unit 321. The inner wheel 120 includes the rotor 122 at a position corresponding to the stator 132. The inner wheel 120 is rotatably provided on the support shaft 111 and disposed in the hollow space of the outer wheel 130. The control unit 110 turns the power of the coil unit 321 on/off and senses whether the outer wheel 130 is operated. The stator 132 of the outer wheel 130 and the rotor 122 of the inner wheel 120 are attached to or separated from each other depending on turning the power applied to the coil unit 321 on/off.

Furthermore, the inner wheel 120 includes the scoreboard 121. The outer wheel 130 has a plurality of grip depressions 131 which are formed around a peripheral portion of the outer wheel 130, and a cover 133 which is coupled to the front end of the outer wheel 130 to isolate the stator 132 coupled to the support shaft 111 from the outside. The power supply 140 supplies power to the stator 132. As shown in FIG. 5 showing a detailed exploded perspective view of the elements of the drive shaft, the drive apparatus 100 further includes an LED unit 150 which detects a position at which the inner wheel 120 is stopped and transmits it to the display unit 101 which is disposed on the outer surface of the roulette game machine.

In detail, the stator 132 includes the coil unit 321, the metal plate 322 which covers the coil unit 321, and a bearing B which comes into contact with the support shaft 110.

The support shaft 111 is placed in the horizontal direction through the inner wheel 120 and the outer wheel 130. The rotor 122 provided in the inner wheel 120 and the stator 132 provided in the outer wheel 130 are coupled to the support shaft 111 by the respective bearings B.

As shown in FIG. 6, the drive apparatus of the present invention includes a stopper unit 160 which exhibits visual effects and has the stopper 162 on an upper portion thereof. In this embodiment, although the stopper unit 160 is illustrated as being exposed out of the outer wheel 130 in the drawing, the stopper unit 160 may be provided in a space formed between the inner wheel 1.20 and the cover 133 provided in the outer wheel 130, as necessary. In the case where the stopper unit 160 is provided outside the outer wheel 130, the stopper 162 is disposed at a position at which it can come into contact with the stop pins 211 provided on the scoreboard 121 of the inner wheel 120.

The stopper 112 stays at the same position and is made of an elastic material. Thus, when the inner wheel 120 rotates, the stopper 112 comes into contact with the stop pins 211 and is elastically rotated and flicked by the stop pins 211 so that the stopper 112 applies a predetermined intensity of resistance to the stop pins 211 to decelerate the inner wheel 120.

Hereinafter, the inner and outer wheels will be explained in more detail with reference to FIGS. 7 and 8 which are sectional views showing the assembled elements of the inner and outer wheels.

The inner wheel 120 includes the rotor 122 and the scoreboard 121. The rotor 122 is rotatably coupled to the support shaft 111 by the bearing B and includes a base plate 221 which is made of metal so that when the stator 132 of the outer wheel 130 is operated, the rotor 122 is attached to the stator 132 by the electromagnetic force generated by the operation of the stator 132 and is thus integrally rotated with the stator 132. The scoreboard 121 is partitioned into many sections at predetermined intervals, and scores are printed on the respective sections. The stop pins 211 are disposed on the respective boundary lies between adjacent sections.

The rotor (electro magnetic rotor) 122 is rotatably coupled to the support shaft 111 and integrally coupled to the scoreboard 121 by a fastening bolt V. The rotor 122 includes the base plate 221 made of metal. Thus, when power is supplied to the stator 132, the base plate 221 is attached to the stator 132 by electromagnetic force generated from the stator 132 so that the rotor 122 is rotated along with the stator 132 around the support shaft 111.

The stop pins 211 provided on the scoreboard 121 come into contact with the stopper 112 and thus produce friction therebetween so that the inner wheel 120 is slowly stopped. In addition, the stop pins 211 function as the boundary lines between the sections formed on the scoreboard 21.

For this, the stopper unit 160 includes a tension spring 163 which is coupled at a first end thereof to a corresponding end of the stopper 162, and a tension wire 164 which is coupled to a second end of the tension spring 163 and wound around a pulley 165 of the motor 166 so that the length of the tension wire 164 is increased or reduced depending on the rotation of the motor 166.

The outer wheel 130 has the grip depressions 131 formed on the peripheral portion thereof at positions spaced apart from each other at predetermined continuous intervals to allow a game player to easily hold the outer wheel 130. Furthermore, the outer wheel 130 includes the stator 132 which is coupled to the support shaft 101, and the transparent cover 133 which is coupled to the front surface thereof to isolate the inner wheel 120 from the outside.

The stator 132 is integrally coupled to the cover 133 by fastening bolts V and includes the coil unit 321 to which power is applied from the power supply 140 when turned on, and the metal plate 322 which covers the coil unit 321. When electric current is applied to the coil unit 321, the metal plate 322 has electromagnetic characteristics. As a result, the rotor 122 of the inner wheel 120 is attached to the metal plate 322 by electromagnetic force generated from the metal plate 322.

The metal plate 322 has a receiving depression 323 into which the coil unit 321 is inserted. In other words, the coil unit 321 is fixed in the receiving depression 323 of the metal plate 322. As such, because the coil unit 321 is inserted and fixed in the receiving depression 323 formed in the metal plate 322 and maintained in the inserted and fixed state, the coil unit 321 is prevented from being removed from its correct position when the game machine is in operation.

The power supply 140 supplies power to the stator 132. In detail, the power supply 140 supplies power ranging from 12 VDC to 24 VDC to the coil unit 321 of the stator 132 to generate electromagnetic force. The power supply 140 is interlocked with a sensor which will be explained later, and is operated in such a way that power is supplied to the coil unit 321 or interrupted by a sensing signal generated from the sensor.

In other words, when it is determined that a game begins, the inner wheel 120 is fastened to the outer wheel 130 by electromagnetic force. In this state, when a user rotates the outer wheel 130 in one direction, the inner wheel is also rotated in the same direction in which the outer wheel is rotated. When the outer wheel 130 and the inner wheel 120 have rotated one turn or reach a predetermined speed, the supply of power to the coil unit 321 of the outer wheel 130 is interrupted. Then, the inner wheel 120 is separated from the outer wheel 130 so that the inner and outer wheels 120 and 130 independently rotate and thereafter decelerated by separate speed reducers before they eventually stop.

In detail, when the control unit 110 determines that the outer wheel 130 is operated, it applied power to the coil unit 321. Then, the stator 132 is electromagnetized so that the rotor 122 is attached to the stator 132. Thereby, the inner wheel 120 is rotated along with the outer wheel 130. When the control unit 110 determines that, after power has been applied to the coil unit 321, a predetermined time period has passed, the speed of the wheels 120 and 130 has reached a predetermined speed, or the wheels 120 and 130 have rotated a predetermined number of times, the control unit 110 interrupts the supply of power to the coil unit 321 so that the inner wheel 120 is separated from the outer wheel 130 and then the wheels 120 and 130 independently rotate.

As such, when the control unit 110 interrupts the supply of power, the outer wheel 130 is decelerated by the speed reducer which is configured such that the bearings 182 of the bearing plate 180 that is rotatably provided on the support shaft 111 come into close contact with the wheel plate 190 of the outer wheel 130 to reduce the rotational force. The inner wheel 120 is stopped by frictional force generated in such a way that the stopper 162 comes into contact with the stop pins 211. Here, the stopper 162 is connected to the second end of the tension spring 163. The tension of the tension spring 163 is adjusted by winding in the tension wire 164 connected to the pulley 165 of the stopper motor 166 or by unwinding it therefrom.

Using the stopper unit 160 having the above-mentioned construction makes it possible to change the position at which the inner wheel 120 stops. In other words, the game can interest the player more by changing the position at which the inner wheel 120 stops. After the control unit 110 determines whether the inner wheel 120 stops at a preset position, if it is determined that the inner wheel 120 stops at the preset position, the control unit 110 varies the tension of the stopper 162 using the motor 166 to vary frictional force applied to the stop pin 211. Thereby, the position at which the inner wheel 120 stops can be varied.

For this, to detect the rotation direction and position of the inner wheel 120, a point check disk (point CHKDSK) is fastened to the rotor 122 of the inner wheel 120, and an encoder sensor 152 and a point sensor are provided on the LED unit 150. When slots of the point CHKDSK fastened to the inner wheel 120 pass through the encoder sensor 152, the rotation direction of the inner wheel 120 can be determined, that is, whether the inner wheel 120 rotates to the left or the right. Furthermore, the position of the inner wheel 120 can be determined in such a way that the encoder sensor calculates the number of slots of the point CHKDSK by detecting points at which point holes of the point CHKDSK pass through the point sensor.

The LED unit 150 functions to sense the position at which the inner wheel 120 stops and display a score on the display unit 101 which is located outside the roulette game machine. The LED unit 150 has a circular planar shape and includes a rotational plate 151 which is fastened to the rotor 122 and has sensor holes 151*a* of the number corresponding to the number of sections of the scoreboard 121 provided on the inner wheel 120, and a pair of sensors 152 which are provided at diametrically symmetric positions and detects the position of the rotational plate 151.

Furthermore, the LED unit 150 further includes LEDs 153 which flash on and off to provide various visual effects when the inner wheel 120.

The rotational plate 151 is integrally fastened to the rotor 122 of the inner wheel 120 by fastening bolts V. The rotational plate 151 has the sensor holes 151*a* of the number corresponding to the number of sections of the scoreboard 121 provided on the inner wheel 120. When the inner wheel 120 rotates, the rotational plate 151 rotates along with the inner wheel 120. When the inner wheel 120 is stopped by resistance with the stopper 162 and by a reduction of kinetic energy, the sensor 152 detects the corresponding sensor holes 151*a*, thus determining which one of the sections of the stopped scoreboard 121 the stopper 162 is disposed in.

Here the two sensors 152 detect the positions of the sensor holes 151*a* with reference to data regarding the sensor holes 151*a* that has been previously stored in the control unit 110. The information detected by the sensors 152 is displayed on the display unit 101 to provide the information to the player.

Moreover, when the inner wheel 120 rotates, the LEDs 153 repeatedly flash on and off to exhibit visual effects. Preferably, the LEDs 153 comprise various colors of LEDs which are arranged in radial directions to express a variety of visual effects. In addition, the sound unit 103 may make various sound effects while the LEDs 153 are operated.

It is preferable that a sequence along which the LEDs 153 flashes on and off and sound effects produced by the sound unit 103 be controlled by a control program which has been previously stored in the control unit 110.

Hereinafter, the operation of the present invention will be described with reference to the related drawings.

Figure 9:
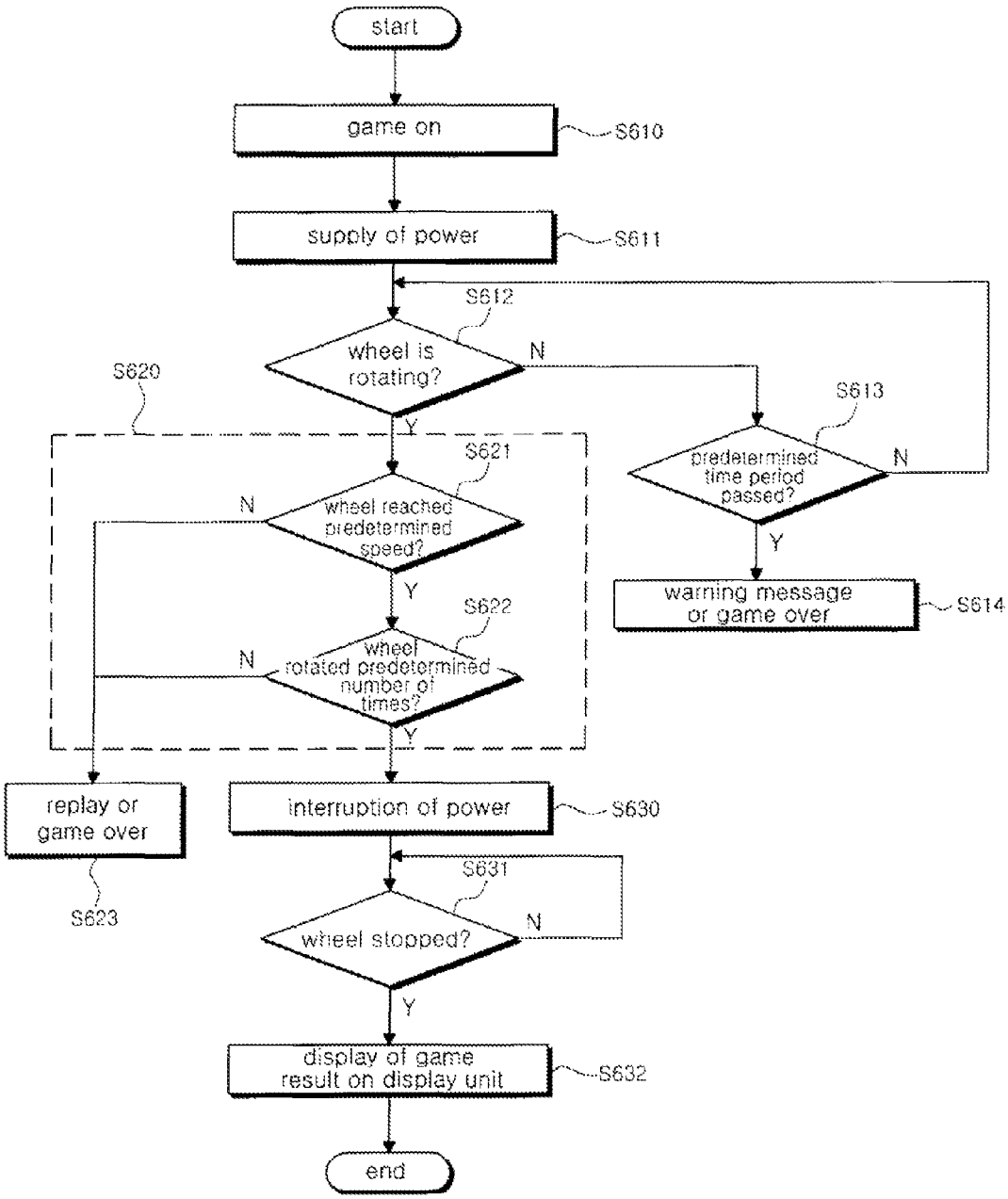
FIG. 9 is a flowchart of a method of driving the roulette game machine.
Figure 10:
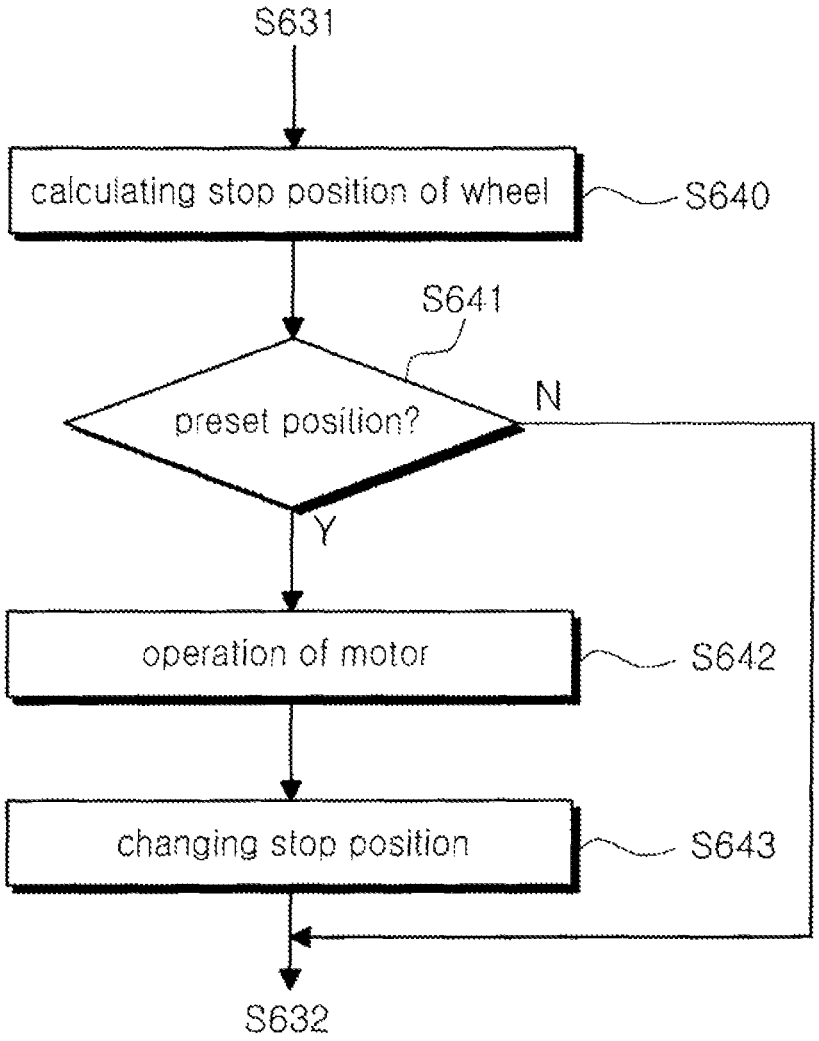
FIG. 10 is a flowchart of a method of stopping the inner wheel.

FIG. 9 is a flowchart of a method of driving the roulette game machine, and FIG. 10 is a flowchart of a method of stopping the inner wheel.

At step S610, the player holds the peripheral portion of the outer wheel 130 that has the grip depressions 31 and rotates the outer wheel 130 in a leftward or rightward direction that the player desires, thus beginning a game. Then, at step S611, the stator. 132 provided on the outer wheel 130 is also rotated along with the outer wheel 130, and power is applied from the power supply 140 to the coil unit 321 of the stator 132. Thereby, electromagnetic force is generated by the coil unit 321 and the metal plate 322. Then, the rotor 122 which is integrally fastened to the inner wheel 120 is attached to the stator 132 by the generated electromagnetic force so that the rotor 122 rotates along with the stator 132.

At step S612, the control unit 110 determines whether the outer wheel 130 or the inner wheel 120 is rotating. If it is determined that the outer wheel 130 and the inner wheel 120 are not rotating, the control unit 110 determines whether a predetermined time period has passed, at step S613. When it is determined that a predetermined time period has passed, at step S614, a warning message is expressed by the display unit 101 or the sound unit 103, or the game is over.

On the other hand, at step S612, if it is determined that the outer wheel 130 and the inner wheel 120 are rotating, the control unit 110 determines whether the speed at which the wheels rotate has reached a predetermined speed and the wheels have rotated a predetermined number of times, at step S621 and S622. When it is determined that the rotation of the wheels satisfies the preset standards, the control unit 110 interrupts the supply of power to the coil unit 321 to slowly stop the inner wheel 120, at step S630.

Preferably, when power is interrupted after it has been supplied from the power supply 140 to the coil unit 321 for about 3 to 5 seconds, electromagnetic force which has been generated by the coil unit 321 and the metal plate 322 is eliminated so that the rotor 122 is separated from the stator 132 and independently rotated from the stator 132. The outer wheel 130 from which the inner wheel 120 is separated is slowly stopped by a reduction of rotational force in such a way that the bearings of the bearing plate which is rotatably provided on the support shaft 111 are brought into close contact with the wheel plate of the outer wheel 130. The inner wheel 120 is slowly stopped by frictional force generated when the stopper 162 comes into contact with the stop pins 211.

Here, when the rotation of the wheels 120 and 130 does not satisfy the preset standards, the control unit 110 may force the player to try a game again or end the game, at step 623.

After the inner wheel 120 has completely stopped, the player may know the result of the game by checking the position of the stopper 162 on the scoreboard 121 with the naked eye and, simultaneously, confirm the result using the display unit 101, at step S632.

Of course, as mentioned above, the position at which the inner wheel 120 stops can be changed by adjusting the tension of the tension spring 163 coupled to the corresponding end of the stopper 162 in such a way that the tension wire 164 which is coupled to the tension spring 163 and wound around the pulley of the motor 166 is varied in length by rotating the motor 166.

Referring to FIG. 10 showing a flowchart of the method of stopping the inner wheel 120, at step S640, the control unit 110 estimates the position at which the inner wheel 120 stops. At step S641, the control unit 110 determines whether the inner wheel 120 stops at the preset position. When it is determined that the inner wheel 120 stops at the preset position, the motor is operated to adjust the tension of the stopper 162, at step S642. Thereby, the position at which the inner wheel 120 stops can be changed, at step 643.

As described above, in the present invention, the game is played in such a way that a game player directly holds an outer wheel and rotates it and an inner wheel having a scoreboard is independently rotated from the outer wheel after the inner wheel is rotated along with the outer wheel during a predetermined time period. Therefore, the present invention can attract active participation from players. Furthermore, various visual effects and sound effects can be produced by LEDs and a speaker. Because the result of a game is determined without interference of external factors, there is no possibility of trickery.

Although the preferred embodiment of the present invention has been disclosed for illustrative purposes, those skilled in the art will appreciate that various modifications, additions, and substitutions are possible, without departing from the scope and spirit of the invention as disclosed in the accompanying claims.

The invention claimed is:

1. A method of driving a roulette game machine, comprising an inner wheel, an outer wheel, and a coil unit configured such that an inner wheel and an outer wheel are attached to each other by electromagnetic force generated from the coil unit and are rotated, the roulette game machine being played in such a way that a scoreboard which is disposed inside the outer wheel and partitioned into a plurality of sections at predetermined intervals is rotated, and a score is determined depending on a position at which a stopper of the inner wheel is placed on the scoreboard when the scoreboard stops, the method comprising:

(a) supplying power to the coil unit to attach the inner wheel to the outer wheel so that the inner wheel is rotated along with the outer wheel;

(b) determining using a control unit whether one from among a speed at which the inner wheel rotates, the number of rotations of the inner wheel, and a duration during which the inner wheel rotates exceeds a corresponding preset standard;

(C) interrupting the power supplied to the coil unit using the control unit to separate the inner wheel from the outer wheel when, at (b) determining, one from among the speed, the number of rotations, and the rotation duration of the inner wheel exceeds a corresponding preset standard;

(d) checking whether or not the inner wheel is in a stop state; and (e) displaying a score, corresponding to a position of the stopper on the scoreboard, on a display unit when, at (d) checking, it is determined that the inner wheel is in the stop state.

2. The method as set forth in claim 1, wherein (a) supplying comprises supplying power to the coil unit when it is determined that the outer wheel rotates.

3. The method as set forth in claim 2, wherein determining whether the outer wheel rotates comprises determining that the outer wheel rotates when one from among a speed at which the outer wheel rotates, the number of rotations of the outer wheel, and a duration during which the outer wheel rotates exceeds a corresponding preset standard.

4. The method as set forth in claim 1, wherein (c) interrupting comprises:

(c-1) decelerating the separated outer wheel using a speed reducer which is configured in such a way that a bearing of a bearing plate that is rotatably coupled to the support shaft come into close contact with a wheel plate provided on the outer wheel to reduce rotational force of the outer wheel; and (c-2) stopping the inner wheel using friction generated when the stopper comes into contact with stop pins provided on the scoreboard.

5. The method as set forth in claim 4, wherein (c-2) stopping comprises decelerating the inner wheel using a speed reducer, the speed reducer comprising: a motor; a tension spring coupled at a first end thereof to the stopper; and a tension wire coupled to a second end of the tension spring, the tension wire being wound around a pulley of the motor so that a length of the tension wire is varied by rotation of the motor.

6. The method as set forth in claim 1, wherein (d) checking comprises:

(d-1) checking whether or not the inner wheel stops at a preset position; and (d-2) changing a position, at which the inner wheel stops, by adjusting tension of the stopper using the motor when it is determined that the inner wheel stops at the preset position.

7. A method of driving a roulette game machine comprising an inner wheel and an outer wheel which are attached to each other by electromagnetic force and are rotated, the roulette game machine being played, in such a way that a scoreboard which is disposed inside the outer wheel and partitioned into a plurality of sections at predetermined intervals is rotated, and a score is determined depending on a position at which a stopper of the inner wheel is placed on the scoreboard when the scoreboard stops, the method comprising:

(a) supplying power to a coil unit to attach the inner wheel to the outer wheel so that the inner wheel is rotated along with the outer wheel;

(b) determining using a control unit whether one from among a speed at which the outer wheel rotates, the number of rotations of the outer wheel, and a duration during which the outer wheel rotates exceeds a corresponding preset standard;

(C) interrupting the power supplied to the coil unit using the control unit to separate the inner wheel from the outer wheel when, at (b) determining, one from among the speed, the number of rotations, and the rotation duration of the outer wheel exceeds a corresponding preset standard;

(d) checking whether or not the inner wheel is in a stop state; and (e) displaying a score, corresponding to a position of the stopper on the scoreboard, on a display unit when, at (d) checking, it is determined that the inner wheel is in the stop state.

8. The method as set forth in claim 7, wherein (a) supplying comprises supplying power to the coil unit when it is determined that the outer wheel rotates.

9. The method as set forth in claim 7, wherein (c) interrupting comprises:

(c-1) decelerating the separated outer wheel using a speed reducer which is configured in such a way that a bearing of a bearing plate that is rotatably coupled to the support shaft come into close contact with a wheel plate provided on the outer wheel to reduce rotational force of the outer wheel; and (c-2) stopping the inner wheel using friction generated when the stopper comes into contact with stop pins provided on the scoreboard.

10. The method as set forth in claim 9, wherein (c-2) stopping comprises decelerating the inner wheel using a speed reducer, the speed reducer comprising: a motor; a tension spring coupled at a first end thereof to the stopper; and a tension wire coupled to a second end of the tension spring, the tension wire being wound around a pulley of the motor so that a length of the tension wire is varied by rotation of the motor.

11. The method as set forth in claim 7, wherein (d) checking comprises:

(d-1) checking whether or not the inner wheel stops at a preset position; and (d-2) changing a position, at which the inner wheel stops, by adjusting tension of the stopper using the motor when it is determined that the inner wheel stops at the preset position.

* * * * *